United States Patent [19]

Brunet

[11] 4,015,423

[45] Apr. 5, 1977

[54] METAL STRAPS FORMED BY INTERCONNECTED LINKS

[75] Inventor: Patrick J. C. Brunet, Annecy, France

[73] Assignee: Zuccolo, Rochet & Cie, Annecy, France

[22] Filed: Oct. 29, 1974

[21] Appl. No.: 518,756

[30] Foreign Application Priority Data

Oct. 30, 1973 France ..... 73.40371

[52] U.S. Cl. ..... 59/82

[51] Int. Cl.[2] ..... F16G 13/18

[58] Field of Search ..... 59/80, 82, 78, 90, 91; 63/4; 224/4 B, 4 D, 4 H

[56] References Cited

UNITED STATES PATENTS

| | | | |
|---|---|---|---|
| 1,589,423 | 6/1926 | Payton | 59/80 |
| 1,605,077 | 11/1926 | Shelsey | 59/80 |
| 2,055,541 | 9/1936 | Kestenman | 59/80 |
| 3,190,067 | 6/1965 | Kammerer | 59/79 B |
| 3,609,963 | 10/1971 | Ichinose | 59/80 |

*Primary Examiner*—C.W. Lanham
*Assistant Examiner*—Gene P. Crosby

[57] ABSTRACT

A metal strap for wrist watches and the like formed of links each consisting of a box-like link frame having four sides over-turned towards the underside of the strap and a base closing the link frame. One side of each link frame has a rectangular aperture forming a cross pin along the free edge of said one side. The opposite side of the link frame forms a hook engaging the aperture of an adjacent link frame, the link frames being held together by link bases inserted therein, the link bases having bosses and notches corresponding to the hooks and apertures of the link frames.

6 Claims, 6 Drawing Figures

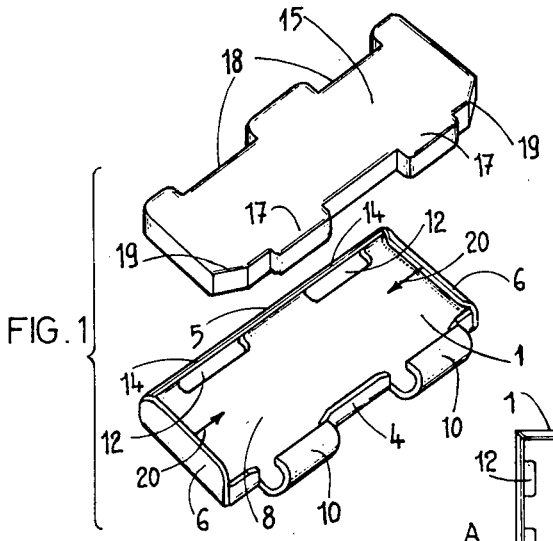
FIG. 1
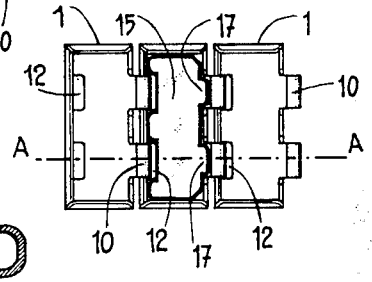
FIG. 2
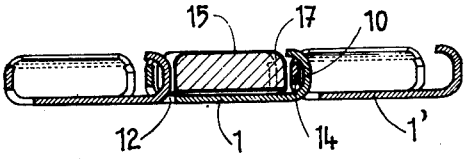
FIG. 3
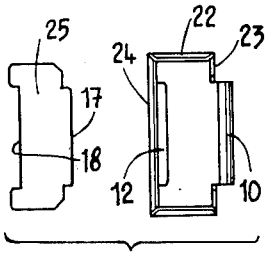
FIG. 4
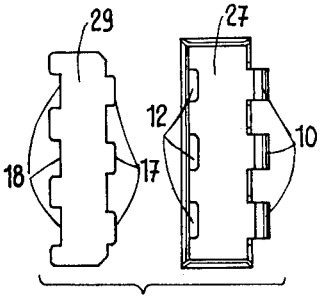
FIG. 5
FIG. 6
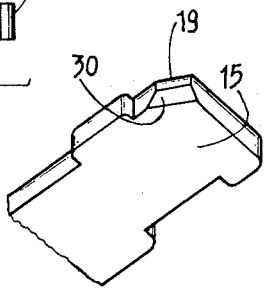

FIG. 2 is a view from below of three links according to FIG. 1, shown hooked together by their hooks, the base only of the central link being in position.

FIG. 3 is a section on line A—A, FIG. 2,

FIG. 4 is an underneath plan of a link frame with a single hook, and a corresponding link base, FIG. 5 is an underneath plan of a link frame with three hooks, and a corresponding link base, and FIG. 6 is a partial view in perspective of a modified construction of a link base in which the corner bevel of the base has a chamfer.

Referring to FIG. 1, a link frame 1 is produced by stamping and shaping thin sheet metal, for example stainless steel. The frame has the general shape of a rectangular box, comprising two sides 4 and 5, perpendicular to the longitudinal axis of the metal strap, and sides 6, parallel with said axis, which are turned over towards the under side of the wrist-watch strap, that is towards the top 8 of the link frame. Two hooks 10 project from the side 4 of the link frame while in the opposite side 5, and extending into the top 8 of the link frame, there are formed two apertures 12 to receive hooks 10 of another link. The apertures 12 leave cross-pins 14 formed from the material remaining between the aperture and the end ridge of the side 5.

A link base 15, which is also shown in FIG. 1, is of such a thickness as to correspond with the depth of the link frame 1.

The base 15, which is intended to be pushed into the link frame 1, comprises two bosses 17 the function of which is to be located in the hooks 10, while two notches 18 opposite the bosses 17 leave a free passage for the hooks 10 of an adjacent link frame 1, not shown. The corners of the edge of the base 15 are advantageously bevelled at 19 so as to allow a point to be introduced, once the link is assembled, between the base 15 and the base 8 of the link frame, which point permits the base 15 to be raised and freed from the link frame 1. The two sides 6 parallel with the longitudinal axis of the metal strap may be of a height equal to or slightly greater or less than that of the sides 4; the sides 6 are bent inwardly so as to form, in part at least, an angle of less than 90° with the top 8; thus when the link base 15 is put into position in the link frame 1 it will be resiliently held by the pressure, as shown by 20, of the sides 6.

FIG. 2 shows three link frames hooked together by their hooks 10 in the corresponding apertures 12 in the link frame. This hooking up takes place on the cross-pin 14, not shown, of each link frame; as long as a base 15 is not in position in the link frame it is possible to unhook the link frame from an adjacent link frame; on the other hand, if the link base 15 is in position, as is the central link frame of the three link frames illustrated in FIG. 2, the bosses 17 close the opening of the hooks 10 of the link frame receiving the base and thus hold captive the cross-pins 14 of the link frame inserted in the hooks 10.

These features are more clearly shown in FIG. 3 where the cross-pin 14 of the link frame 1′ can be seen to be held captive in the hook 10 of the link frame 1 by the boss 17, closing the hook 10 from the link base 15. It will be clear that when the bases 15 have been removed the cross-pins 14 can be taken out of the hooks 10 of the adjacent link frame and that it will thus be possible to remove as many link frames as thought necessary; conversely it would be possible to add as many links as required to the metal strap, each link being locked to a previous link by the placing in the frame of the previous link the base of the corresponding link.

In the construction shown in FIG. 4 the link frame 22 has, on its turned-over sides 23 and 24 perpendicular to the longitudinal axis of the strap, only one hook 10 and one aperture 12 respectively. Correspondingly, the base 25 of a link frame of this kind has only a single boss 17 and a singe notch 18.

In the construction shown in FIG. 5, the link frame 27 has, distributed evenly over its turned-over sides perpendicular to the longitudinal axis of the strap, three hooks 10 and three apertures 12, respectively. The base 29, which is intended to close the link frame 27, is provided on its edges with three bosses 17 the function of which is to close the hooks 10 and three notches 18 which leave the apertures 12 free.

FIG. 6 shows the bevelled corner 19 of a base 15 having a chamfer 30 which, when the base is in position in the corresponding link frame, facilitates the insertion of the point which is required for separating the base 15 and the link frame, the latter not being shown in the drawing.

It will be understood that in accordance with the invention it will be possible to provide each link frame with as many hooks and corresponding apertures as may be considered necessary; all that is required is that there shall be, corresponding with these hooks and apertures, bosses and notches in the base intended for the link frames.

It should be noted, furthermore, that in some forms of construction which have not been illustrated the link base could consist, not of a solid part but a shaped element, so long as the edges, or more precisely the turned-over edges of the shaped element, have the same features (boss and notch) as those of the edges of the solid bases.

It is also to be understood that the bevelling of the corners of the link base edges can be carried out either on the edge containing the bosses or the one with the notches, or that the base may be provided with any means, such as at least one perforation for example, to give a grip for the purpose of extracting it from a corresponding link frame.

What we claim is:

1. A metal strap, particularly a strap for a wrist-watch, comprising links each of which consists of a link frame in the form of a generally rectangular box with a top and four sides turned over towards an underside of the strap to define an open bottom of the link frame, each link frame having on one side at least one substantially rectangular aperture leaving a free edge part of said side which forms a cross-pin, and, projecting from the side opposite said one side, at least one corresponding integral hook which passes through a corresponding said aperture in an adjacent link frame and pivotally engages about the corresponding cross-pin, and link bases each engaged in the open bottom of a link frame to hold the adjacent link frames together, each link base having on one edge at least one boss which holds captive the cross-pin of an adjacent link frame in the corresponding hook of the link frame and, on an opposite edge, means defining at least one recess which leaves a free passage for the hook of another adjacent link frame accommodating the cross-pin of the link frame in which said link base is fitted.

2. A strap according to claim 1, wherein each link base is held in position in a link frame by the resilient

METAL STRAPS FORMED BY INTERCONNECTED LINKS

This invention relates to a metal strap, particularly a strap for a wrist-watch, which strap can easily be assembled to the required length. Known metal straps for wrist-watches generally consist of links made up of a relatively large number of parts and comprising pins, or bores for the passage of pins, linking one link to the next. In spite of the resiliency usually imparted to these wrist-watch straps by the addition of a suitable fastener some adjustment of the length is generally needed. This length adjustment, which has to be carried out at the time when the strap is sold, causes difficulty in most cases owing to the fact, in particular, that special tools have to be used. Moreover with straps of the known kind the links may have decorative spangles or ornamentations which then run the risk of being damaged during the length adjustment.

A strap the subject of the invention is intended to reduce these disadvantages in a simple and effective way.

According to the invention a metal strap, particularly a strap for a wrist-watch, comprises links each of which consists of a link frame in the form of a four-sided box the sides of which are perpendicular to one another and the opposite sides are parallel, said sides being overturned towards the under side of the strap, and a base operable to close the link frame. The link frame has the general shape of a box with four sides, parallel in pairs, the four sides being turned over towards the underside of the watch strap, two perpendicular to the longitudinal axis of said strap.

Each link frame has, on one turned-over side, at least one substantially rectangular aperture forming a cross-pin with the edge of said one side and, projecting from the side opposite said one side, at least one corresponding hook, said cross-pin and hook constituting the means of connection between the link frame and an adjacent link frame. In the course of assembly of the strap, the hook of one link frame will be introduced into the corresponding aperture on the edge of the adjacent link frame, the hook receiving into its concavity the cross-pin formed by the material remaining between the aperture of the adjacent link side and the ridge of the turned over edge comprising this aperture. Once two links have been hooked together in this way, there will be put into the link frame, the hook of which is holding the crosspin of the adjacent link, a base which has the function both of closing the link frame and of holding the crosspin captive but capable of swivelling in the hook. The base, which has substantially the shape and the thickness of the link frame, is mounted in the link frame and exerts force against the sides of the link frame parallel to the longitudinal axis of the strap, which sides of the frame are turned over so as to form, in their terminal portion at least, an angle of slightly less than 90° with the top of the link frame, thus resiliently securing the normal retention in position of said base. The base has on one edge at least one boss which holds captive the cross-pin of an adjacent link frame in the corresponding hook of the link frame and, on an opposite side, at least one notch which leaves a free passage for the hook of another adjacent link frame accommodating the cross-pin of the link frame to which the link base is fitted. It will be understood that in this way it will be easy to make up a wristwatch strap by introducing in succession the hook of one link frame into the apertuure of an adjacent link frame and by locking this hook-up over the cross-pin of said adjacent link by inserting a base into the link frame.

When the watch strap is complete its length can easily be adjusted by taking out one or more links. To make this possible, that is to say to dismantle the links, the ends, preferably of the edge of the link base carrying the boss which closes the hook, are bevelled off so as to permit the insertion, into a corner of the link fitted to correspond with this bevel, of a pointed implement which, penetrating as far as the base of the link frame, will be forced between the base of the link frame and the link base, causing the latter to come out of said link frame in opposition to the retention force exerted resiliently by two of the sides of the frame, thus releasing the hook-up of the cross-pin in the hook of the link frame; by repeating this operation on successive links it will clearly be possible to remove the required number of links from the wrist-watch strap; it would also be possible, by the same procedure, to open links in order to hook them on to the watch strap to lengthen it. When the length adjustment is completed, the link bases will be put into position in the corresponding links thus locking the assembled watch strap.

In accordance with one embodiment the link frames may each comprise a plurality of hooks and corresponding cross-pins, and the link base has as many bosses and notches as there are hooks and cross-pins respectively on the link frame. The bases will then have as many closing bosses and notches as there are hooks and cross-pins on the link frame for which they are intended.

The simplicity of construction of each link, which can be dismantled, will be noted since the link consists of only two parts which effect not only the composition of the link, but also the interconnection of the links, the locking of the connection, and the capacity for being disconnected from one another. Moreover the base of the link is advantageously obtained by stamping, the ridges made by the stamping tool being made on the face of the base which is intended to come into contact with the skin of the wearer of the watch, the effect of which is, without any further finishing operation, to round off the ridges formed by said face and the edges of the base, thereby avoiding any irritation due to friction against the skin.

In other forms of construction each of the link bases consists of an element which is stamped and shaped, the turned-over edges having the same bosses and notches as the edges of the solid bases.

Again, the link bases, whether stamped or stamped and shaped, may have at least one perforation to give a grip for the purpose of extracting them from the corresponding link frame.

It is quite clear that the link frames may be constructed from any suitable metal, may undergo any plating process, be provided with any chequering, diamond settings, etc., since there is no risk of their becoming damaged in any way during the operations of assembling or opening the links.

The invention will now be described, by way of example, with reference to the accompanying drawings, in which:

FIG. 1 is a perspective view of a link according to the invention, pressure of the two sides of the link frame substantially parallel with the longitudinal axis of the strap, said two sides forming, at least in their terminal portion, an angle of less than 90° with the top of the link frame.

3. A strap according to claim 1, wherein each link base is solid and is of a thickness substantially equal to the depth of the link frames.

4. A strap according to claim 1, wherein each link frame comprises a plurality of hooks and corresponding cross-pins, and the link base has as many bosses and notches as there are hooks and cross-pins respectively on the link frame.

5. A strap according to claim 1, wherein each link base has at least one corner bevel by means of which it is possible to force between the link frame and a fitted link base a pointed implement which has the function of permitting extraction of the link base from the link frame.

6. A strap according to claim 5, wherein at least one bevel at the corner of the link base comprises a chamfer which facilitates the insertion of an extracting pointed implement between the link frame and the link base.

* * * * *